US006474904B1

(12) United States Patent
Duckett et al.

(10) Patent No.: US 6,474,904 B1
(45) Date of Patent: Nov. 5, 2002

(54) TRAFFIC BARRIER WITH LIQUID FILLED MODULES

(75) Inventors: John W. Duckett, Carson City, NV (US); Owen S. Denman, Sacramento, CA (US); Jack S. Mazer, Benicia, CA (US)

(73) Assignee: Barrier Systems, Inc., Rio Vista, CA (US)

( * ) Notice: Subject to any disclaimer, the term of this patent is extended or adjusted under 35 U.S.C. 154(b) by 0 days.

(21) Appl. No.: 09/961,539

(22) Filed: Sep. 24, 2001

(51) Int. Cl.[7] ..... E01F 15/08
(52) U.S. Cl. ..... 404/6; 256/13.1
(58) Field of Search ..... 404/6, 9, 10; 256/1, 256/13.1

(56) References Cited

U.S. PATENT DOCUMENTS

| | | | | | |
|---|---|---|---|---|---|
| 3,980,279 | A | * | 9/1976 | Bofinger | 404/6 |
| 4,498,803 | A | * | 2/1985 | Quittner | 404/6 |
| 4,500,225 | A | * | 2/1985 | Quittner | 404/6 |
| 4,661,010 | A | * | 4/1987 | Almer et al. | 404/6 |
| 4,773,629 | A | | 9/1988 | Yodock | |
| 4,806,044 | A | * | 2/1989 | Duckett | 404/6 |
| 4,828,425 | A | * | 5/1989 | Duckett | 404/6 |
| 4,869,617 | A | * | 9/1989 | Chiodo | 404/6 |
| 4,946,306 | A | | 8/1990 | Yodock | |
| 5,011,325 | A | * | 4/1991 | Antonioli | 404/6 |
| 5,046,884 | A | * | 9/1991 | Girotti | 404/6 |
| 5,054,954 | A | | 10/1991 | Cobb et al. | |
| 5,123,773 | A | | 6/1992 | Yodock | |
| 5,387,049 | A | * | 2/1995 | Duckett | 404/6 |
| 5,531,540 | A | | 7/1996 | Wasserstrom et al. | |
| 5,605,413 | A | * | 2/1997 | Brown | 404/6 |
| 5,678,950 | A | * | 10/1997 | Junker | 404/10 |
| 5,860,762 | A | * | 1/1999 | Nelson | 404/6 |
| 5,882,140 | A | * | 3/1999 | Yodock, Jr. et al. | 404/6 |
| 6,059,491 | A | * | 5/2000 | Striefel et al. | 404/6 |
| 6,203,242 | B1 | * | 3/2002 | Englund | 404/6 |
| 2002/0025221 | A1 | * | 2/2002 | Johnson | 404/6 |

* cited by examiner

*Primary Examiner*—Thomas B. Will
*Assistant Examiner*—Alexandra K. Pechhold
(74) *Attorney, Agent, or Firm*—Thomas R. Lampe

(57) ABSTRACT

A traffic barrier includes a plurality of attached modules containing liquid. The modules can be modified to provide different levels of impact resistance performance when impacted by a vehicle.

33 Claims, 5 Drawing Sheets

TRAFFIC BARRIER WITH LIQUID FILLED MODULES

TECHNICAL FIELD

This invention relates to a traffic barrier and more particularly to a traffic barrier including a plurality of attached traffic barrier modules, each including a liquid filled module body.

BACKGROUND OF THE INVENTION

It is known in the prior art to provide vehicular barrier systems comprised of a plurality of attached traffic barrier modules, the modules being filled with water to provide the weight necessary for the barrier to be capable of absorbing the force of impact by a vehicle while deflecting the vehicle along another path of movement.

Examples of barrier systems filled with liquid or other filler material are disclosed in the following United States Patents: U.S. Pat. No. 4,773,629, issued Sep. 27, 1988, U.S. Pat. No. 5,531,540, issued Jul. 2, 1996, U.S. Pat. No. 5,123,773, issued Jun. 23, 1992, U.S. Pat. No. 4,946,306, issued Aug. 7, 1990, and U.S. Pat. No. 5,054,954, issued Oct. 8, 1991.

Prior art vehicular barrier systems, including those incorporating liquid filled modules, are generally specifically designed and engineered to attain a certain performance level when impacted by a vehicle. This performance level may be considerably in excess of the performance level actually required or appropriate at a specific location or in specific circumstances. For example, it is not necessary, and in some cases perhaps undesirable, to utilize a traffic barrier designed for high impact force applications where the nature of the vehicles on the roadway or the particular roadway conditions do not require such a level of performance. Report No. 350 of the National Cooperative Highway Research Program may be referred to for additional information concerning highway barrier standards and performance levels generally.

Many prior art liquid filled barrier arrangements are characterized by their relative complexity, high cost and difficulty of assembly. The modules often incorporate metal framework within their interiors which can result in corrosion and failure due to contact with the liquid.

DISCLOSURE OF INVENTION

The present invention relates to a traffic barrier including a plurality of attached traffic barrier modules. Each module includes a module body defining an interior for accommodating water or other liquid and having a top, a bottom, opposed side walls and opposed end walls.

First attachment means is connected to the module body attaching the module body to at least one adjacent module body whereby the traffic barrier attains a first level of impact resistance performance when impacted by a vehicle.

The traffic barrier module also includes second attachment means for selective connection to the module body at a location on the module body spaced from the first attachment means or, alternatively, for removal from the module body.

The second attachment means, when connected to the module body, attaches the module body to one or more adjacent module bodies whereby the traffic barrier attains a second level of impact resistance performance when impacted by a vehicle which exceeds the first level of performance.

Other features, advantages and objects of the present invention will become apparent with reference to the following description and accompanying drawings.

BEST MODE FOR CARRYING OUT THE INVENTION

Figure 1:
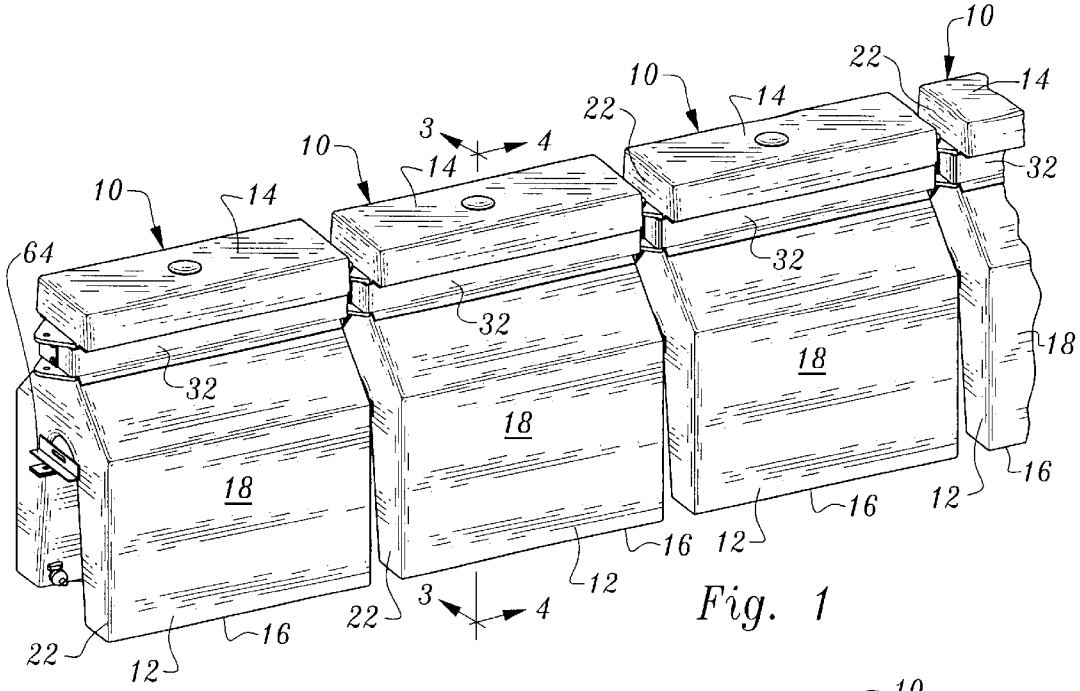
FIG. 1 is a perspective view of a portion of a traffic barrier constructed in accordance with the teachings of the present invention and including a plurality of attached traffic barrier modules.
Figure 2:
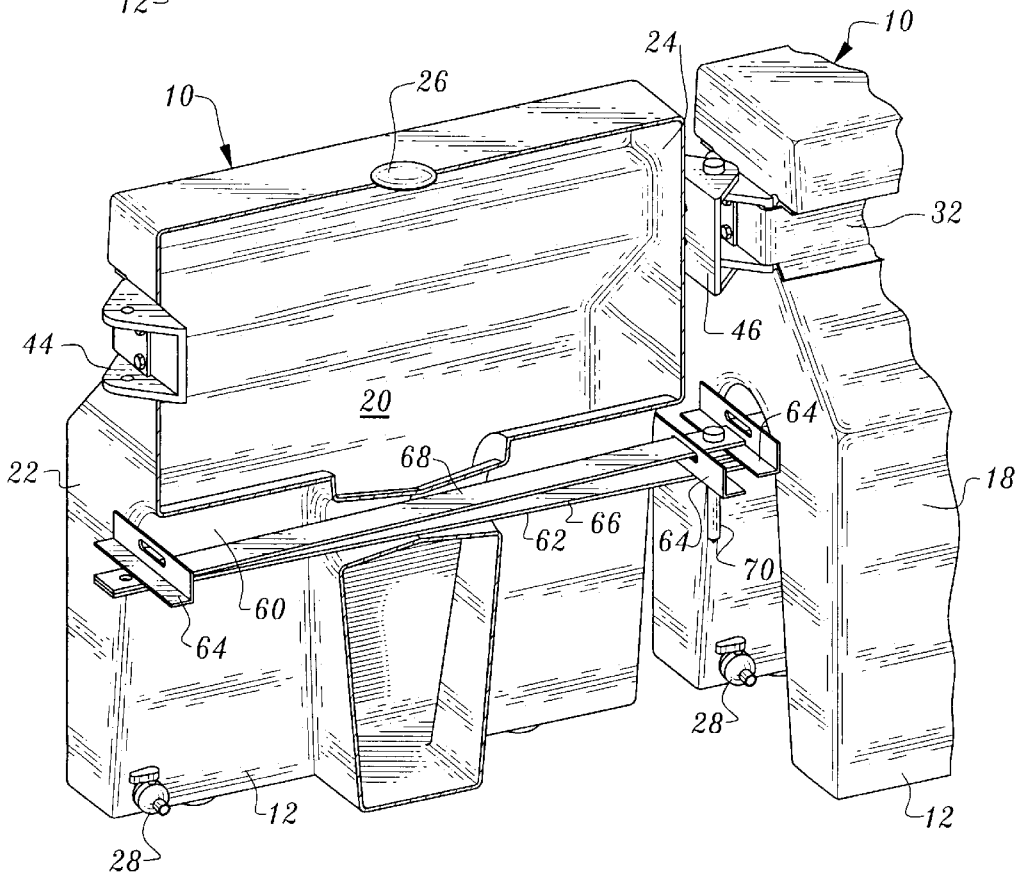
FIG. 2 is an enlarged perspective view illustrating one complete traffic module and a portion of another module attached thereto, the complete traffic module being shown in cross-section, and the module including both first and second attachment means.
Figure 4:
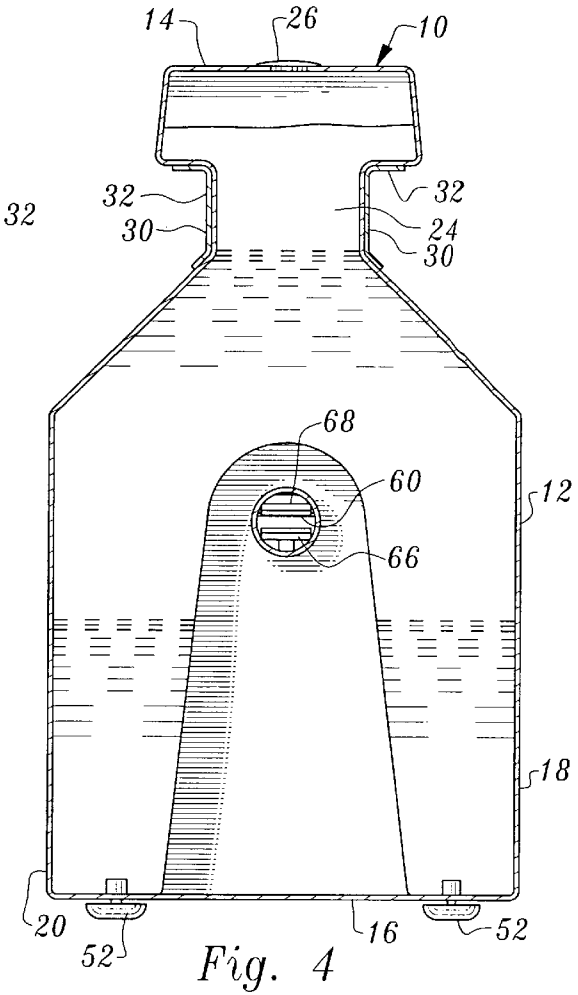
FIG. 4 is an enlarged cross-sectional view taken along the line 4—4 in FIG. 1.
Figure 3:
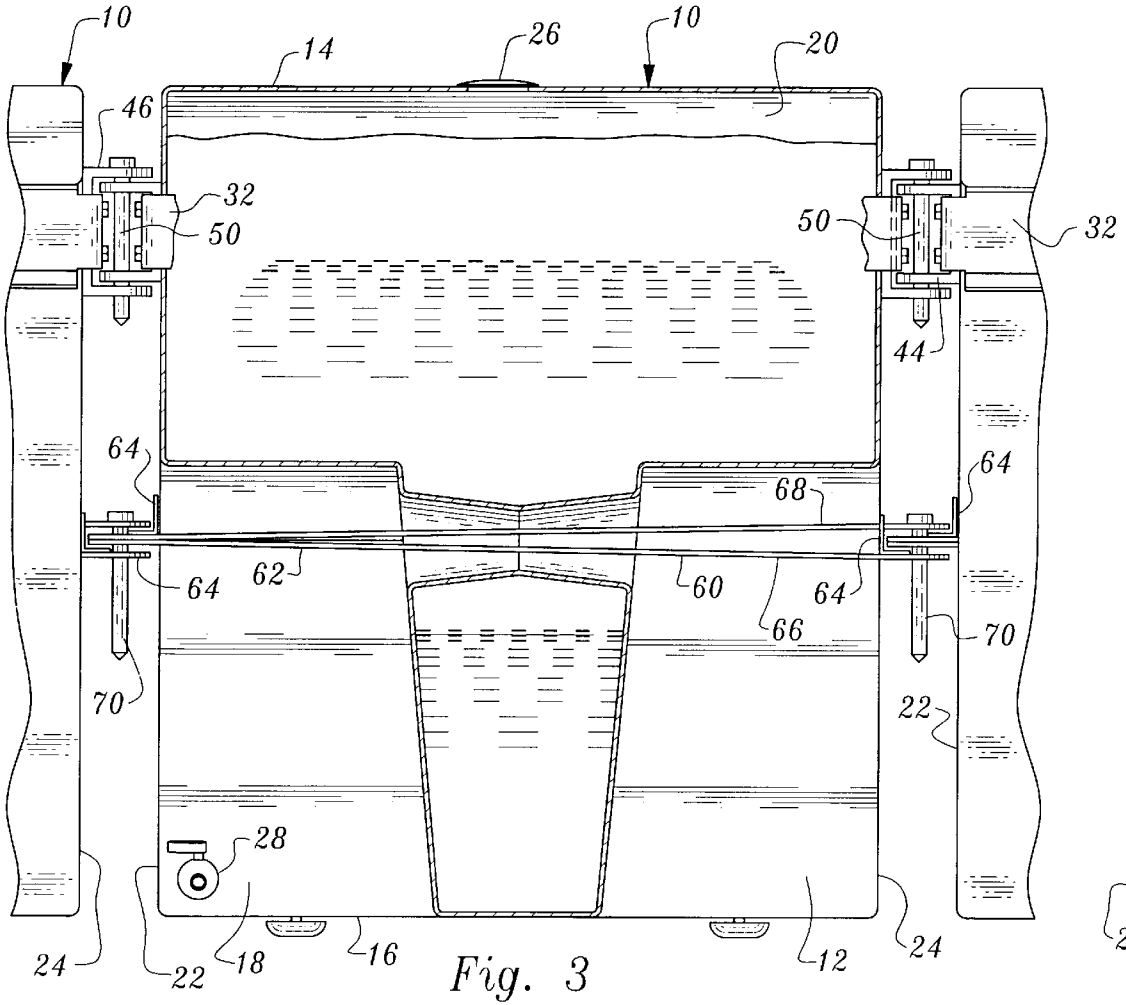
FIG. 3 is an enlarged cross-sectional view taken along the line 3—3 in FIG. 1.
Figure 5:
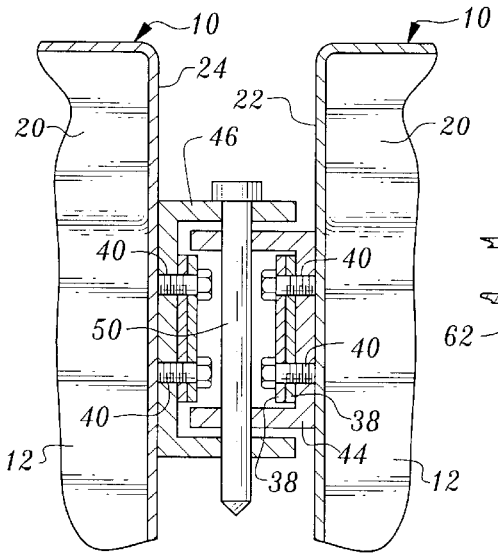
FIG. 5 is a greatly enlarged cross-sectional view illustrating details of structural components of the first attachment means incorporated in the traffic barrier.
Figure 6:
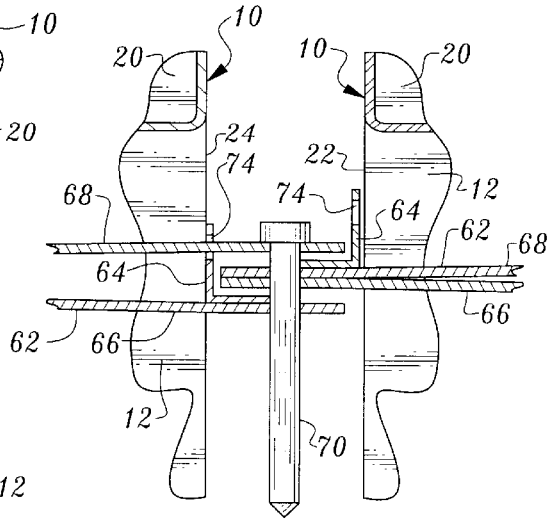
FIG. 6 is a view similar to FIG. 5, but illustrating details of selected portions of the second attachment means incorporated in the traffic barrier attaching two traffic barrier modules.

Referring now to the drawings, a traffic barrier constructed in accordance with the teachings of the present invention includes a plurality of attached traffic barrier modules 10.

The modules 10 in the arrangement illustrated are of identical construction and each includes a module body 12 defining an interior for accommodating liquid, typically water, and having a top 14, a bottom 16, opposed side walls 18, 20 and opposed end walls 22, 24. The module body is suitably formed of relatively rigid plastic material such as polyethelene.

A removable liquid filler cap 26 releasably covers an opening in the top 14 to allow liquid to be introduced into the interior of the module body. A drain cock 28 allows the module body 12 to be emptied. It will be appreciated that the module body is normally filled after it is placed in operative position and emptied when the module is to be moved or transported.

The module includes first attachment means connected to the module body attaching the module body to adjacent module bodies to form the traffic barrier. In particular, side walls 18, 20 define recesses 30 near top 14 which accommodate a band 32 encircling the module body, the band suitably formed of a metal such as steel.

Figure 8:
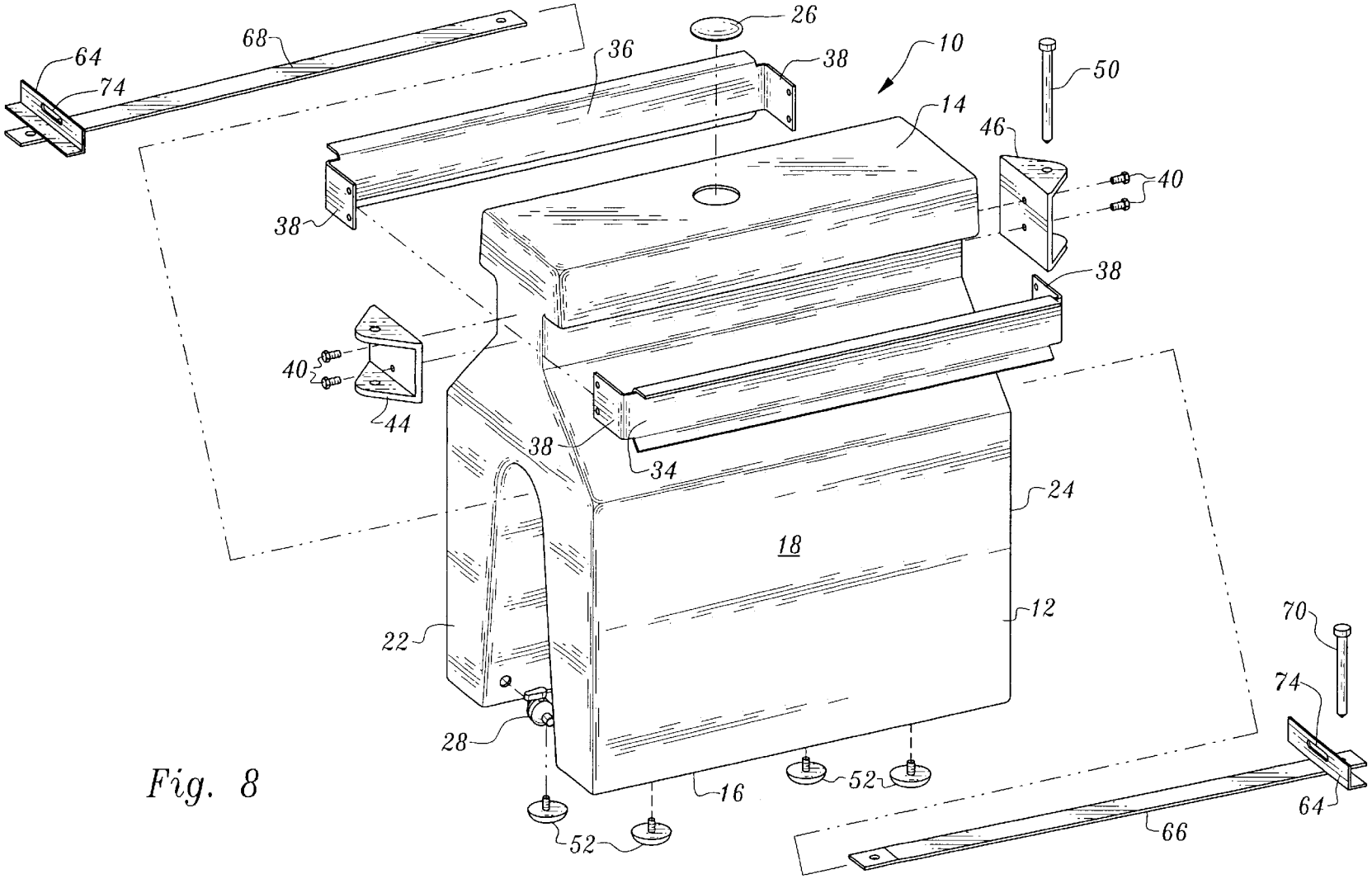
FIG. 8 is an exploded perspective view illustrating components of a traffic barrier module prior to assembly thereof, and illustrating the structural components utilized in both the first and second attachment means.

As perhaps can best be seen with reference to FIG. 8, the band comprises two band segments 34, 36 which have inturned flanges 38 which extend over end walls 22, 24 in overlapping relationship. The flanges 38 have openings which are in registry and receive bolts 40. The band segments also have flanges at the tops and bottoms thereof to conform to the shapes of the side walls to provide bearing surfaces.

The first attachment means also includes attachment members in the form of brackets 44, 46 which are disposed between the end walls of the module body and the overlapping flanges 38. The bolts 40 threadedly engage the brackets 44, 46 to maintain the band segments 34, 36 and brackets 44, 46 together as a unit, the band clamping the module body. Disposing the band in a recess provides sufficient clearance to enable the module to freely pass through commercially available machines used to reposition roadway barriers without interfering with their operation. The brackets have openings which are aligned and which receive a connector pin 50 at the location of each pair of brackets. Bracket 46 is sized to receive bracket 44.

Figure 7:
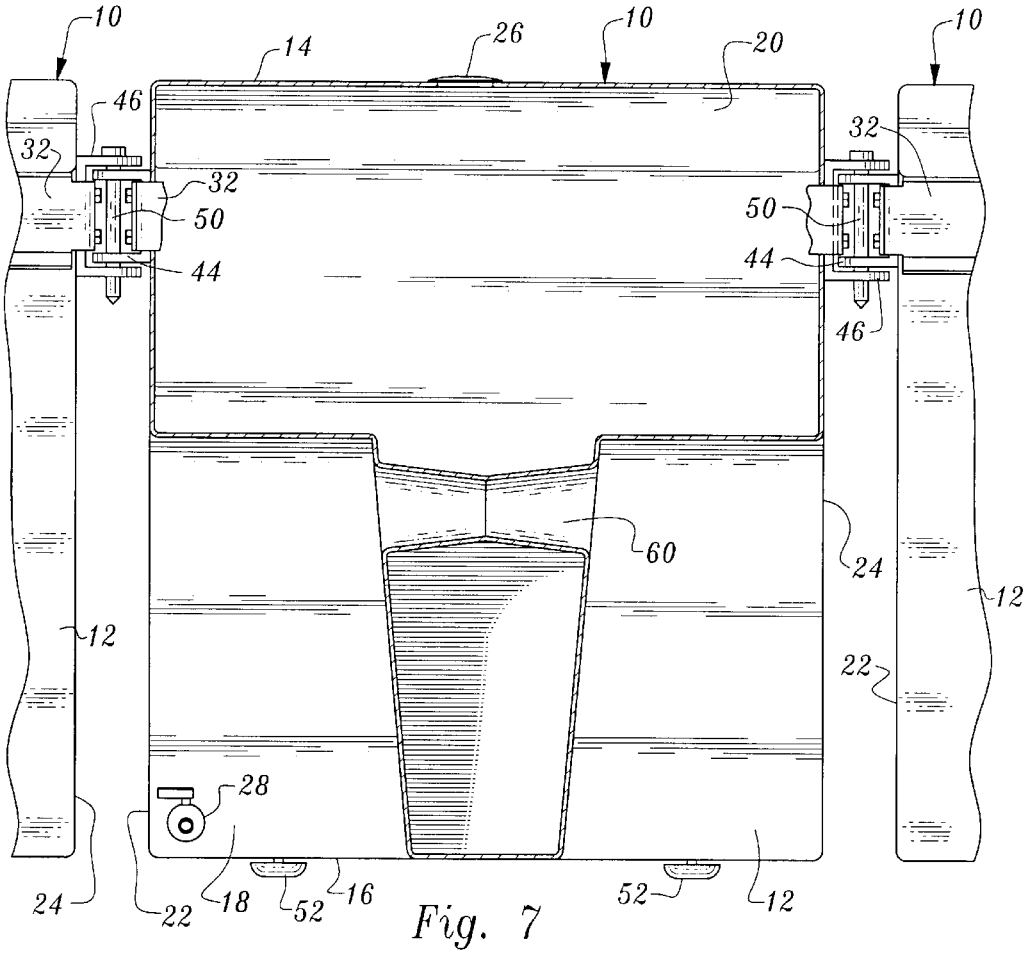
FIG. 7 is a view similar to FIG. 3, but illustrating adjacent traffic barrier modules attached only by the first attachment means, the second attachment means having been removed from the illustrated barrier modules.

FIG. 7 shows the module 10 with only the first attachment means, including band 32 and brackets 44, 46, used to attach adjacent modules. This arrangement allows the traffic barrier to attain a first level of impact resistance performance when impacted by a vehicle. Such performance can be measured by how far the barrier is deflected when impacted by a vehicle under specified conditions. Support feet 52 on the bottoms of the modules can be of a skid resistant nature to assist in the resisting of displacement of the modules when impacted.

FIGS. 1–4 and 6 show the use of a second attachment means when a higher level of impact resistance performance is desired. The second attachment means, when utilized, is disposed below the first attachment means.

Module body 12 defines a passageway 60 which passes through the interior and is separated from the water or other liquid in the interior. The passageway extends between the end walls 22, 24. The second attachment means comprises a double-ended, relatively rigid, elongated attachment member 62 which has ends projecting from the end walls of the module body when connected to the module body.

The attachment member ends include abutment members 64 which are in the form of bent steel plates having an L-shaped cross-section. Each of the plates 64 has a flat abutment surface extending substantially parallel to an end wall of the module body when the second attachment means is connected to the module body. The abutment members restrict movement of the second attachment means relative to the module bodies when installed thereon and also apply forces to the module bodies upon deflection of the barrier which resist pivotal movement between adjacent modules.

The attachment member 62 comprises two releasably interconnected elongated attachment member portions 66, 68 which are of identical construction and interchangeable. The portions 66, 88 of each attachment member are in substantial registry.

Selectively removable attachment pins 70 are utilized to secure the attachment member portions 66, 68 together and also to secure together the ends of adjacent elongated attachment members 62.

The attachment pins pass through aligned apertures formed in the elongated member portions, and an abutment member let, 64 is located closely adjacent to each of the apertures. Suitably, an abutment member is welded to the rest of its associated elongated member portion.

It will be noted that each of the abutment members 64 defines a slot or opening 74. These openings receive an end of an elongated attachment member portion to maintain a space between ends of the two releasably interconnected, elongated attachment member portions. This space receives the ends of the attachment member portions of the elongated attachment member 62 associated with an adjacent module to facilitate installation and attachment of the second attachment means. It will be appreciated that the second attachment means, when installed, allows the traffic barrier to attain the second level of impact resistance performance when impacted by a vehicle which exceeds the first level of performance which exists when only the first attachment means is installed. Installation and removal of the second attachment means can readily and quickly be carried out.

The traffic barrier can be laterally transferred and repositioned by machine while the modules are interconnected.

Figure 11:
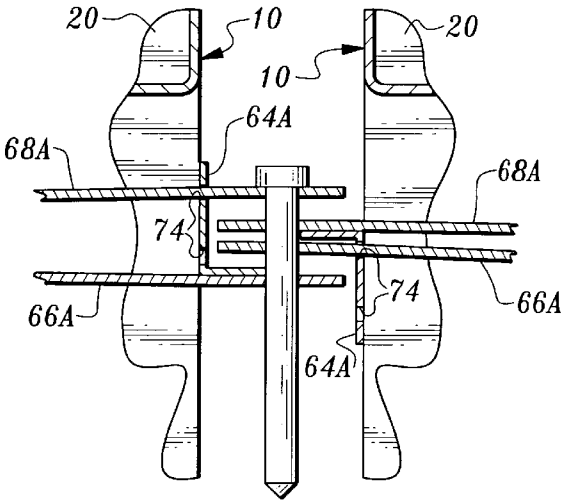
FIG. 11 is a view similar to FIG. 6, but illustrating interconnected alternative attachment member embodiments.
Figure 9:
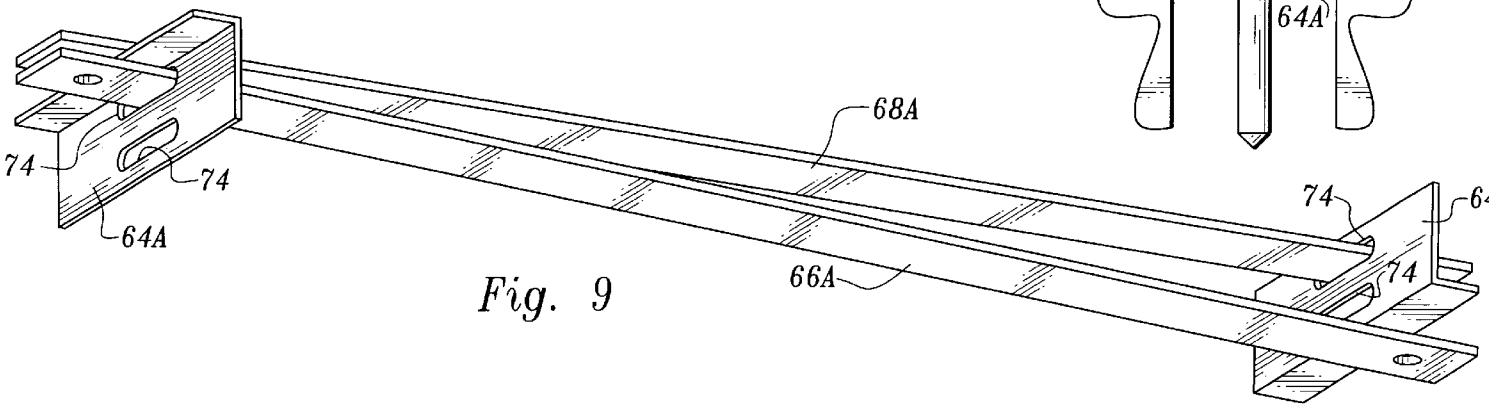
FIG. 9 is a perspective view of an alternative embodiment of attachment member.
Figure 10:
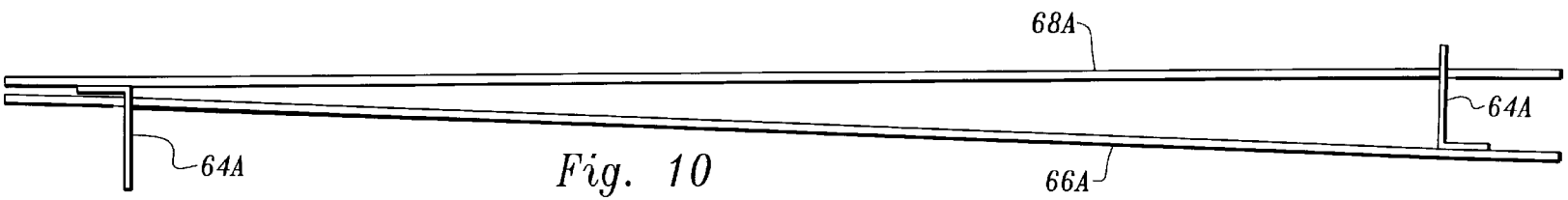
FIG. 10 is a side, elevational view of the alternative attachment member embodiment.

FIGS. 9, 10 and 11 illustrate an alternative form of second attachment means. In this embodiment, the abutment members 64A of the elongated attachment member portions 66A and 68A each have two spaced slots or openings 74 formed therein which can be employed to vary the angle of divergence between the elongated attachment member portions.

The invention claimed is:

1. A traffic barrier including a plurality of attached traffic barrier modules, each module of said attached traffic barrier modules comprising, in combination:

a module body defining a hollow interior for accommodating water or other liquid and having a top, a bottom, opposed side walls and opposed end walls, said module body including passageway defining structure defining a passageway passing through said hollow interior and separated from any water or other liquid in said hollow interior, said passageway defining structure extending completely between said opposed end walls and said passageway communicating with openings in said opposed end walls;

first attachment means connected to said module body attaching said module body to at least one adjacent module body whereby said traffic barrier attains a first level of impact resistance performance when impacted by a vehicle; and second attachment means for selective connection to said module body at a location on said module body spaced from said first attachment means or, alternatively, for removal from said module body, said second attachment means when connected to said module body extending completely through said passageway and projecting from both the opposed end walls attaching said module body to one or more adjacent module bodies whereby said traffic barrier attains a second level of impact resistance performance when impacted by a vehicle which exceeds said first level of impact resistance performance.

2. The traffic barrier according to claim 1 wherein a recess is defined by at least some of the walls of said module body, said first attachment means being positioned in said recess and disposed wholly externally of said module body.

3. The traffic barrier according to claim 2 wherein said first attachment means comprises a band encircling said module body and disposed in said recess and attachment members affixed to said band and located at the first and second end walls of said module body.

4. The traffic barrier according to claim 1 additionally comprising support feet attached to the bottom of said module body.

5. The traffic barrier according to claim 1 wherein said first attachment means is located closer to the top of said module body than to the bottom thereof.

6. The traffic barrier according to claim 1 wherein said second attachment means comprises a double-ended, elongated attachment member, the ends of said attachment member projecting beyond the end walls of the module body when said second attachment means is connected to said module body.

7. The traffic barrier according to claim 6 wherein said attachment member ends include abutment members for abutting engagement with the end walls of the module body to restrict movement of said second attachment means relative to said module body when said second attachment means extends through said passageway.

8. The traffic barrier according to claim 7 wherein said attachment member comprises two releasably interconnected elongated attachment member portions, said elongated attachment member portions being in substantial registry.

9. The traffic barrier according to claim 8 wherein an abutment member is located at one end of each of said elongated attachment member portions, each abutment member having a flat abutment surface extending substantially parallel to an end wall of the module body when said second attachment means is connected to said module body.

10. A traffic barrier module for use in a traffic barrier including a plurality of attached traffic barrier modules, said traffic barrier module comprising, in combination:

a module body defining a hollow interior for accommodating water or other liquid and having a top, a bottom, opposed side walls and opposed ends walls, said module body including passageway defining structure defining a passageway passing through said hollow interior and separated from any water or other liquid in said hollow interior, said passageway defining structure extending completely between said opposed end walls and said passageway communicating with openings in said opposed end walls;

first attachment means connected to said module body for attaching said module body to two adjacent module bodies whereby the traffic barrier will attain a first level of impact resistance performance; and second attachment means for selective connection to said module body at a location on said module body spaced from said first attachment means or, alternatively, for removal from said module body, said second attachment means when connected to said module body extending completely through said passageway and projecting from both of the opposed end walls for attaching said module body to one or more adjacent module bodies whereby the traffic barrier will attain a second level of impact resistance performance which exceeds said first level of impact resistance performance.

11. The traffic barrier according to claim 10 wherein a recess is defined by at least some of the walls of said module body, said first attachment means being positioned in said recess.

12. The traffic barrier according to claim 11 wherein said first attachment means comprises a band encircling said module body and disposed in said recess and attachment members affixed to said band and located at the first and second end walls of said module body.

13. The traffic barrier according to claim 10 wherein said first attachment means is located closer to the top of said module body than to the bottom thereof.

14. The traffic barrier according to claim 8 additionally comprising support feet attached to the bottom of said module body.

15. The traffic barrier according to claim 8 wherein said second attachment means comprises a double-ended, elongated attachment member, the ends of said attachment member projecting beyond the end walls of the module body when said second attachment means is connected to said module body.

16. The traffic barrier according to claim 15 wherein said attachment member ends include abutment members for abutting engagement with the end walls of the module body to restrict movement of said second attachment means relative to said module body when said second attachment means extends through said passageway.

17. The traffic barrier according to claim 16 wherein said attachment member comprises two releasably interconnected elongated attachment member portions, said elongated attachment member portions being in substantial registry.

18. The traffic barrier according to claim 17 wherein an abutment member is located at one end of each of said elongated attachment member portions, each abutment member having a flat abutment surface extending substantially parallel to an end wall of the module body when said second attachment means is connected to said module body.

19. A traffic barrier including a plurality of attached traffic barrier modules, each module of said attached traffic barrier modules comprising, in combination:

a module body defining an interior for accommodating water or other liquid and having a top, a bottom, opposed side walls and opposed end walls;

first attachment means connected to said module body attaching said module body to at least one adjacent module body whereby said traffic barrier attains a first level of impact resistance performance when impacted by a vehicle; and second attachment means for selective connection to said module body at a location on said module body spaced from said first attachment means or, alternatively, for removal from said module body, said second attachment means when connected to said module body attaching said module body to one or more adjacent module bodies whereby said traffic barrier attains a second level of impact resistance performance when impacted by a vehicle which exceeds said first level of performance, a recess being defined by at least some of the walls of said module body, said first attachment means being positioned in said recess and disposed wholly externally of said module body, and said first attachment means comprising a band encircling said module body and disposed in said recess and attachment members affixed to said band and located at the first and second end walls of said module body.

20. The traffic barrier according to claim 19 additionally comprising connector pins, said attachment members comprising brackets receiving said connector pins.

21. The traffic barrier according to claim 19 wherein said band comprises a plurality of band segments secured together and affixed to said attachment members by mechanical fasteners.

22. A traffic barrier including a plurality of attached traffic barrier modules, each module of said attached traffic barrier modules comprising, in combination:

a module body defining an interior for accommodating water or other liquid and having a top, a bottom, opposed side walls and opposed end walls;

first attachment means connected to said module body attaching said module body to at least one adjacent module body whereby said traffic barrier attains a first level of impact resistance performance when impacted by a vehicle; and second attachment means for selective connection to said module body at a location on said module body spaced from said first attachment means or, alternatively, for removal from said module body, said second attachment means when connected to said module body attaching said module body to one or more adjacent module bodies whereby said traffic barrier attains a second level of impact resistance performance when impacted by a vehicle which exceeds said first level of performance, said module body defining a passageway passing through said interior and separated from any water or other liquid in said interior, said passageway extending between the first and second end walls, said second attachment means, when connected to said module body, extending through said passageway, said second attachment means comprising a double-ended, elongated attachment member, the ends of said attachment member projecting beyond the end walls of the module body when said second attachment means is connected to said module body, said attachment member ends including abutment members for abutting engagement with the end walls of the module body to restrict movement of said second attachment means relative to said module body when said second attachment means extends through said passageway, said attachment member comprising two releasably interconnected elongated attachment member portions, said elongated attachment member portions being in substantial registry, an abutment member being located at one end of each of said elongated attachment member portions, each abutment member having a flat abutment surface extending substantially parallel to an end wall of the module body when said second attachment means is connected to said module body.

23. The traffic barrier according to claim 22 wherein said elongated attachment member portions are of substantially identical construction and interchangeable.

24. The traffic barrier according to claim 23 wherein each of said elongated member portions defines an aperture for receiving an attachment pin.

25. The traffic barrier according to claim 24 wherein an abutment member is located closely adjacent to each of said apertures.

26. The traffic barrier according to claim 25 wherein each of said abutment members defines an opening receiving an end of an elongated attachment member portion for maintaining a space between ends of said two releasably interconnected, elongated attachment member portions when said elongated attachment member portions are in substantial registry.

27. A traffic barrier module for use in a traffic barrier including a plurality of attached traffic barrier modules, said traffic barrier module comprising, in combination:

a module body defining an interior for accommodating water or other liquid and having a top, a bottom, opposed side walls and opposed end walls;

first attachment means connected to said module body and disposed wholly externally of said module body for attaching said module body to two adjacent module bodies; and second attachment means for selective connection to said module body at a location on said module body spaced from said first attachment means or, alternatively, for removal from said module body, said second attachment means when connected to said module body for attaching said module body to one or more adjacent module bodies, a recess being defined by at least some of the walls of said module body, said first attachment means being positioned in said recess, said first attachment means comprising a band encircling said module body and disposed in said recess and attachment members affixed to said band and located at the first and second end walls of said module body.

28. The traffic barrier according to claim 27 wherein said band comprises a plurality of band segments secured together and affixed to said attachment members by mechanical fasteners.

29. A traffic barrier module for use in a traffic barrier including a plurality of attached traffic barrier modules, said traffic barrier module comprising, in combination:

a module body defining an interior for accommodating water or other liquid and having a top, a bottom, opposed side walls and opposed end walls;

first attachment means connected to said module body and disposed wholly externally of said module body for attaching said module body to two adjacent module bodies; and second attachment means for selective connection to said module body at a location on said module body spaced from said first attachment means or, alternatively, for removal from said module body, said second attachment means when connected to said module body for attaching said module body to one or more adjacent module bodies, said module body defining a passageway passing through said interior and separated from any water or other liquid in said interior, said passageway extending between the first and second end walls, said second attachment means, when connected to said module body, extending through said passageway, said second attachment means comprising a double-ended, elongated attachment member, the ends of said attachment member projecting beyond the end walls of the module body when said second attachment means is connected to said module body, said attachment member ends including abutment members for abutting engagement with the end walls of the module body to restrict movement of said second attachment means relative to said module body when said second attachment means extends through said passageway, said attachment member comprising two releasably interconnected elongated attachment member portions, said elongated attachment member portions being in substantial registry, an abutment member being located at one end of each of said elongated attachment member portions, each abutment member having a flat abutment surface extending substantially parallel to an end wall of the module body when said second attachment means is connected to said module body.

30. The traffic barrier according to claim 29 wherein said elongated attachment member portions are of substantially identical construction and interchangeable.

31. The traffic barrier according to claim 30 wherein each of said elongated member portions defines an aperture for receiving an attachment pin.

32. The traffic barrier according to claim 31 wherein an abutment member is located closely adjacent to each of said apertures.

33. The traffic barrier according to claim 32 wherein each of said abutment members defines an opening receiving an end of an elongated attachment member portion for maintaining a space between ends of said two releasably interconnected, elongated attachment member portions when said elongated attachment member portions are in substantial registry.

* * * * *